United States Patent [19]

Lindstadt et al.

[11] Patent Number: 4,858,531

[45] Date of Patent: Aug. 22, 1989

[54] WARHEAD WITH METAL COATING FOR CONTROLLED FRAGMENTATION

[75] Inventors: Klaus Lindstadt, Schwaig; Karl Rudolf, Schrobenhausen, both of Fed. Rep. of Germany

[73] Assignee: Diehl GmbH & Co., Nuremberg, Fed. Rep. of Germany

[21] Appl. No.: 81,246

[22] Filed: Jun. 29, 1987

[30] Foreign Application Priority Data

Jul. 31, 1986 [DE] Fed. Rep. of Germany ..... 3625965

[51] Int. Cl.[4] ..... F42B 1/02

[52] U.S. Cl. ..... 102/307; 102/476; 102/492; 102/506

[58] Field of Search ..... 102/307, 306, 476, 492, 102/506

[56] References Cited

U.S. PATENT DOCUMENTS

| | | | |
|---|---|---|---|
| 2,605,703 | 8/1952 | Lawson | 102/24 |
| 3,388,663 | 6/1968 | Wyman | 102/24 |
| 4,089,267 | 4/1978 | Mescall | 102/67 |
| 4,106,411 | 8/1978 | Borcher et al. | 102/67 |
| 4,499,830 | 2/1985 | Majerus et al. | 102/476 |
| 4,610,204 | 9/1986 | Dunne et al. | 102/476 |
| 4,702,171 | 10/1987 | Tal et al. | 102/476 |

FOREIGN PATENT DOCUMENTS 2429990 1/1980 France .

*Primary Examiner*—Peter A. Nelson

*Attorney, Agent, or Firm*—Scully, Scott, Murphy & Presser

[57] ABSTRACT

A warhead or horizontal fragmentation mine, which includes an explosive charge arranged within a housing, which is covered at the front end thereof with a concave or planar coating or cladding; and a method for producing the warhead. The coating is entirely, or at least overwhelmingly, constituted of a brittle heavy-metal or hard or carbide metal with a static fracture or breaking expansion of 15 or 25%, in which the coating is decomposed during the detonation into a large number of natural fragments or splinters of certain quantity, which spread out in a definite fragment cone or fragment wedge, and wherein the ratio of the quantity of the coating to that of explosive consists of approximately 1:0.4 to 1:0.6.

9 Claims, 1 Drawing Sheet

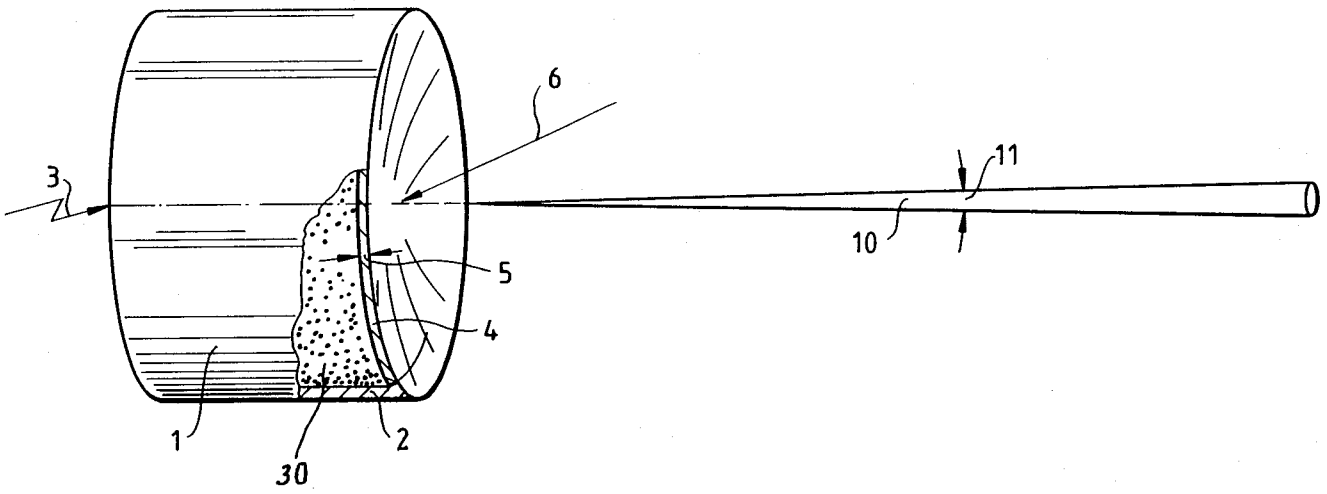
11
10
6
5
4
2
30
1
3

WARHEAD WITH METAL COATING FOR CONTROLLED FRAGMENTATION

BACKGROUND OF THE INVENTION

1. Field of the Invention

The present invention relates to a warhead or horizontal fragmentation mine, which includes an explosive charge arranged within a housing, which is covered at the front end thereof with a concave or planar coating or cladding. The invention also relates to a method for producing the inventive warhead.

2. Discussion of the Prior Art

From the disclosure of German Pat. No. 33 36 516, there has become known a coating and cladding for hollow charges, flat charges and projectile charges with the improved penetrating power of a rotationally-symmetrical hollow charge or in essence, the improved shearing or cutting power of a cutting charge. For this purpose, the cladding is formed from a particle-bonding material which is constituted of tungsten and copper. The individual tungsten granules are combinedthrough a binder medium; for example, nickel or palladium, with the copper into a homogeneous matrix. In accordance therewith, obtained in a spine or barb possessing a high density.

For the attacking of semi-hard (lightly-armored) targets or, in effect, extremely rapidly traveling targets, there are frequently utilized warheads possessing a splinter or fragmentation action. As a result thereof, either the effect or action is improved through a multiple hit, or there is an increase in the probability of a hit. As a rule, heretofore the fragment generation had been obtained through the acceleration of the preformed fragments; for example, which were arranged in a few, relatively thin layers within the warhead. Consequently, the concentration of a large number of fragments over a defined spatial sector could hardly be realized.

SUMMARY OF THE INVENTION

In contrast with the foregoing, it is an object of the present invention to contemplate the provision of a warhead which produces fragments which are highly energetic in an axial direction, and which expand within a defined spatial sector.

The invention obtains the foregoing object through the provision of a warhead in which the coating is entirely, or at least overwhelmingly, constituted of a brittle heavy-metal or hard or carbide metal with a static fracture or breaking expansion of 15 to 25%, in which the coating is decomposed during the detonation into a large number of natural fragments or splinters of certain quantity, which spread out in a definite fragment cone or fragment wedge, and wherein the ratio of the quantity of the coating to that of explosive consists of approximately 1:0.4 to 1:0.6.

Advantageously, the foregoing results in the simple constructed and inexpensive warhead. By means of a usual central detonation there is produced a concentrated splinter or fragment cone of highly-effective fragments within a defined spatial sector, which at a suitable warhead dimension will, at a 100 m distance, penetrate through the bottom plate of a helicopter, constituted of titanium-aluminum, or pierce through the armoring of armored personnel carrier. The weight of a fragment, in this instance, consists of an average of 5 g.

Hereby, the total weight of the fragments consists of approximately 1.2 to 1.3 kg.

As a result, the invention is thereby also suited for land-based mines for the attacking of low-flying helicopters and/or aircraft up to about 100 m above ground.

Important to the present invention is the material from which the coating is constituted. This material must possess a low breaking or fracture expansion at high expansion rates; in effect, at expansion speeds in the magnitude of 1000 m/s and more brittle. Advantageous is a high ductility for the material at low expansion rates, such as are common for non-machining deformation processes. In the current cases of application, there are employed material possessing a static breaking expansion of between 15 and 25%.

Advantageous for the penetrating power of the generated fragments is a high specific density of the coating or cladding material. From theory, it is known that the piercing power of a penetrator is above all, in a first approximation, proportional to the square-root of the penetrator density.

Through the inventive method of producing the warhead, there is provided an inexpensive manufacturing process allowing in a simple manner to predetermine the weight of the fragments.

BRIEF DESCRIPTION OF THE DRAWING

Reference may now be had to the following detailed description of an exemplary embodiment of the invention, taken in conjunction with the single FIGURE of the drawing illustrating, in a generally schematic manner, a perspective view of the inventive warhead.

DETAILED DESCRIPTION

A warhead 1 includes a canister or housing 2, a detonator 3, an explosive 30, and a cladding coating 4.

The coating 4 is constituted of a tungsten-sintered alloy with:

90% by weight of tungsten
6.5% by weight of nickel
3.5% by weight of iron
with an expansion of 25%.

The coating may also be constituted from a molybdenum alloy or a sintered alloy with a molybdenum content of at least 75%; or of brittle tantalum or tantalum alloy or a sintered alloy with a tantalum content of at least 70%; or of a brittle steel or sintered alloy with an iron content of at least 90%.

Upon the detonation of the warhead 1, the coating 4 is deformed into a splinter or fragment cone 10 with a cone angle 11 of 2°. The fragmentation cone 10 possesses fragments with an average fragment weight of 5 g. The thickness of the coating 4 is designated with reference numeral 5, and the radius of curvature with reference numeral 6.

The following data also form the basis for the achieved result.

Diameter of the coating 4=100 mm
Weight of the explosive 30=2.4 kg
Weight of the coating 4=1.37 kg
Radius of curvature 6
of the coating 4=180 mm For a horizontal fragmentation mine for the attacking of thinly-armoured targets, the above-mentioned data would be modified so as to obtain a broad horizontal splinter or fragment jet in the form of a fragment cone wedge having a wedge angle of approximately 2°.

What is claimed is:

1. In a warhead for a horizontal fragmentation mine including a housing; an explosive charge arranged within said housing, and a concave or planar coating covering the front side of said explosive charge; the improvement comprising in that at least the major portion of said coating is constituted of a brittle heavy-metal or hard metal having a static breaking expansion of 15 to 25%, said coating being decomposed upon detonation of said warhead into a large number of natural generally equally-sized and discrete fragments of a certain weight and quantity which spread out within a defined fragment cone or fragment wedge, and wherein the ratio of the weight of coating relative to the explosive is in the range of about 1:0.4 to 1:0.6.

2. A warhead as claimed in claim 1, including a rotationally-symmetrical coating, wherein the ratio of the diameter of the coating to the radius of curvature of the coating is in the range of about 1:0.4 to 1:1.1.

3. A warhead as claimed in claim 1, wherein the coating is selected from the group of materials essentially consisting of tungsten, a tungsten alloy or a sinter alloy with a tungsten content of ≧70%.

4. A warhead as claimed in claim 1, wherein the coating is selected from the group of materials essentially consisting of a molybdenum alloy or a sinter with a molybdenum content of ≧75%.

5. A warhead as claimed in claim 1, wherein the coating is selected from the group of materials essentially consisting of of brittle tantalum, a brittle tantalum alloy or a brittle sinter alloy with a tantalum content of ≧70%.

6. A warhead as claimed in claim 1, wherein the coating is selected from the group of materials essentially consisting of brittle steel or a sinter alloy with an iron content of ≧90%.

7. A warhead as claimed in claim 1, wherein said coating is formed by a flat plate deformed into a concave configuration.

8. A warhead as claimed in claim 1, wherein the curvature of the coating conforms at least partly to a conical cross-section.

9. A warhead as claimed in claim 1, wherein the coating is additionally embrittled through a heat treatment in at least predetermined regions thereof.

* * * * *